US010744769B2

(12) United States Patent
Kakiuchi et al.

(10) Patent No.: US 10,744,769 B2
(45) Date of Patent: Aug. 18, 2020

(54) LIQUID EJECTION HEAD INCLUDING VIBRATING FILM AND PIEZOELECTRIC FILM DEFLECTING TOWARD PRESSURE CHAMBERS

(71) Applicant: Brother Kogyo Kabushiki Kaisha, Nagoya-shi, Aichi-ken (JP)

(72) Inventors: Toru Kakiuchi, Chita-gun (JP); Taiki Tanaka, Yokkaichi (JP); Yuichi Ito, Mie-gun (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 16/432,226

(22) Filed: Jun. 5, 2019

(65) Prior Publication Data

US 2020/0047496 A1 Feb. 13, 2020

(30) Foreign Application Priority Data

Aug. 9, 2018 (JP) ..... 2018-150186

(51) Int. Cl.
*B41J 2/14* (2006.01)
*B41J 2/16* (2006.01)

(52) U.S. Cl.
CPC ..... *B41J 2/14233* (2013.01); *B41J 2/14201* (2013.01); *B41J 2/161* (2013.01); *B41J 2002/14491* (2013.01)

(58) Field of Classification Search
CPC .... B41J 2/14233; B41J 2/14201; B41J 2/161; B41J 2002/14491
See application file for complete search history.

(56) References Cited

U.S. PATENT DOCUMENTS 9,975,331 B2 5/2018 Kato et al.
2002/0080213 A1 6/2002 Shimada et al.
(Continued)

FOREIGN PATENT DOCUMENTS

EP 2730415 A1 5/2014
JP H10-181015 A 7/1998
(Continued)

OTHER PUBLICATIONS

Dec. 13, 2019—(EP) Extended European Search Report—App 19178279.6.

*Primary Examiner* — Geoffrey S Mruk
(74) *Attorney, Agent, or Firm* — Banner & Witcoff, Ltd.

(57) ABSTRACT

A liquid ejection head includes: nozzles; a channel member including a plurality of pressure chambers each in communication with a corresponding one of the nozzles; and a plurality of piezoelectric elements corresponding to the pressure chambers. Each piezoelectric element includes: a vibrating film covering the corresponding pressure chamber; a piezoelectric film positioned opposite to the pressure chamber with respect to the vibrating film; a first electrode interposed between the vibrating film and the piezoelectric film; and a second electrode having compressive stress and positioned opposite to the vibrating film with respect to the piezoelectric film. The piezoelectric film has a ratio of (001) orientation to (100) orientation that is equal to or greater than 50%. The vibrating film and the piezoelectric film are deflected convexly toward the corresponding pressure chamber while no potential difference is produced between the first electrode and the second electrode.

9 Claims, 9 Drawing Sheets

(56) References Cited

U.S. PATENT DOCUMENTS

| | | | | |
|---|---|---|---|---|
| 2005/0157093 | A1 | 7/2005 | Murai | |
| 2011/0122205 | A1 | 5/2011 | Hirai | |
| 2014/0132676 | A1 | 5/2014 | Yazaki | |
| 2015/0022592 | A1* | 1/2015 | Aoyama | B41J 2/14233 347/68 |
| 2015/0042728 | A1 | 2/2015 | Hirai | |
| 2017/0087825 | A1 | 3/2017 | Kato et al. | |
| 2017/0253040 | A1 | 9/2017 | Shinkai et al. | |

FOREIGN PATENT DOCUMENTS

| | | | |
|---|---|---|---|
| JP | 2000-022232 | A | 1/2000 |
| JP | 2000-094688 | A | 4/2000 |
| JP | 2000-208828 | A | 7/2000 |
| JP | 2004-042329 | A | 2/2004 |
| JP | 2009-274226 | A | 11/2009 |
| JP | 2011-110784 | A | 6/2011 |
| JP | 2017-065094 | A | 4/2017 |

* cited by examiner

LIQUID EJECTION HEAD INCLUDING VIBRATING FILM AND PIEZOELECTRIC FILM DEFLECTING TOWARD PRESSURE CHAMBERS

CROSS REFERENCE TO RELATED APPLICATION

This application claims priority from Japanese Patent Application No. 2018-150186 filed Aug. 9, 2018. The entire content of the priority application is incorporated herein by reference.

TECHNICAL FIELD

The present disclosure relates to a liquid ejection head that ejects liquid from nozzles.

BACKGROUND

As a conventional liquid ejection head for ejecting liquid from nozzles, Japanese Patent Application Publication No. 2000-094688 discloses an inkjet recording head for ejecting ink from nozzles. This conventional inkjet recording head has pressure chambers that communicate with nozzles, elastic film covering the pressure chambers, piezoelectric film arranged at an opposite surface of the elastic film from the pressure chambers, a lower electrode film formed between the elastic film and the piezoelectric film, and an upper electrode film arranged on an opposite surface of the piezoelectric film from the elastic film. The piezoelectric film is formed according to the sol-gel process. The upper electrode film has compressive stress that causes the elastic film, piezoelectric film, lower electrode film, and upper electrode film to deflect convexly toward the side opposite the pressure chambers.

SUMMARY

The crystal orientation in lead zirconate titanate (PZT) having a perovskite structure expressed with the chemical formula $ABO_3$ has been known to greatly influence the piezoelectric property of the material. This piezoelectric property generates strain in the crystals in response to an applied voltage. Obtaining thin films preferentially oriented along the c-axis, i.e., (001)-oriented, particularly in PZT having a tetragonal perovskite structure is thought to be effective for producing strong piezoelectric properties. a-axis, i.e., (100) preferentially oriented thin films and the like may produce great deformation when a strong electric field is applied to change the orientation of the c-axis from one parallel to a substrate surface to one perpendicular to the surface, but have been problematic in achieving stable driving since the amount of their deformation tends to be irregular.

With the conventional technology described above, tensile stress is generated in the piezoelectric film because the upper electrode film has compressive stress and, thus, the piezoelectric film tends to be (100)-oriented. A (100) orientation is also common in piezoelectric films formed according to the sol-gel process used in the conventional technology. However, as described above, highly (100)-oriented piezoelectric thin films do not tend to produce good piezoelectric properties when voltage is applied across their upper and lower electrode films.

Further, the elastic film and vibrating film in the conventional technology are deflected convexly toward the side opposite the pressure chambers by the compressive stress in the upper electrode film. However, inkjet recording heads having an elastic film and a vibrating film deflected convexly toward the side opposite the pressure chambers is susceptible to producing crosstalk during driving, as will be described later.

In view of the foregoing, it is an object of the disclosure to provide a liquid ejection head that achieves good piezoelectric properties while inhibiting crosstalk.

In order to attain the above and other objects, according to one aspect, the disclosure provides a liquid ejection head including a plurality of nozzles, a channel member, and a plurality of piezoelectric elements. The channel member includes a plurality of pressure chambers each in communication with a corresponding one of the plurality of nozzles. Each of the plurality of piezoelectric elements is provided for a corresponding one of the plurality of pressure chambers. Each of the plurality of piezoelectric elements includes: a vibrating film covering the corresponding pressure chamber; a piezoelectric film positioned opposite to the corresponding pressure chamber with respect to the vibrating film; a first electrode interposed between the vibrating film and the piezoelectric film; and a second electrode positioned opposite to the vibrating film with respect to the piezoelectric film. The vibrating film, the piezoelectric film, the first electrode, and the second electrode vertically overlap the corresponding pressure chamber. The second electrode has compressive stress. The piezoelectric film has a ratio of (001) orientation to (100) orientation that is equal to or greater than 50%. The vibrating film and the piezoelectric film are deflected convexly toward the corresponding pressure chamber while no potential difference is being produced between the first electrode and the second electrode.

BRIEF DESCRIPTION OF THE DRAWINGS

The particular features and advantages of the embodiment (s) as well as other objects will become apparent from the following description taken in connection with the accompanying drawings, in which.

DETAILED DESCRIPTION

Hereinafter, one embodiment of the disclosure will be described while referring to FIGS. 1 through 9.

<Overall Structure of Printer 1>

Figure 1:
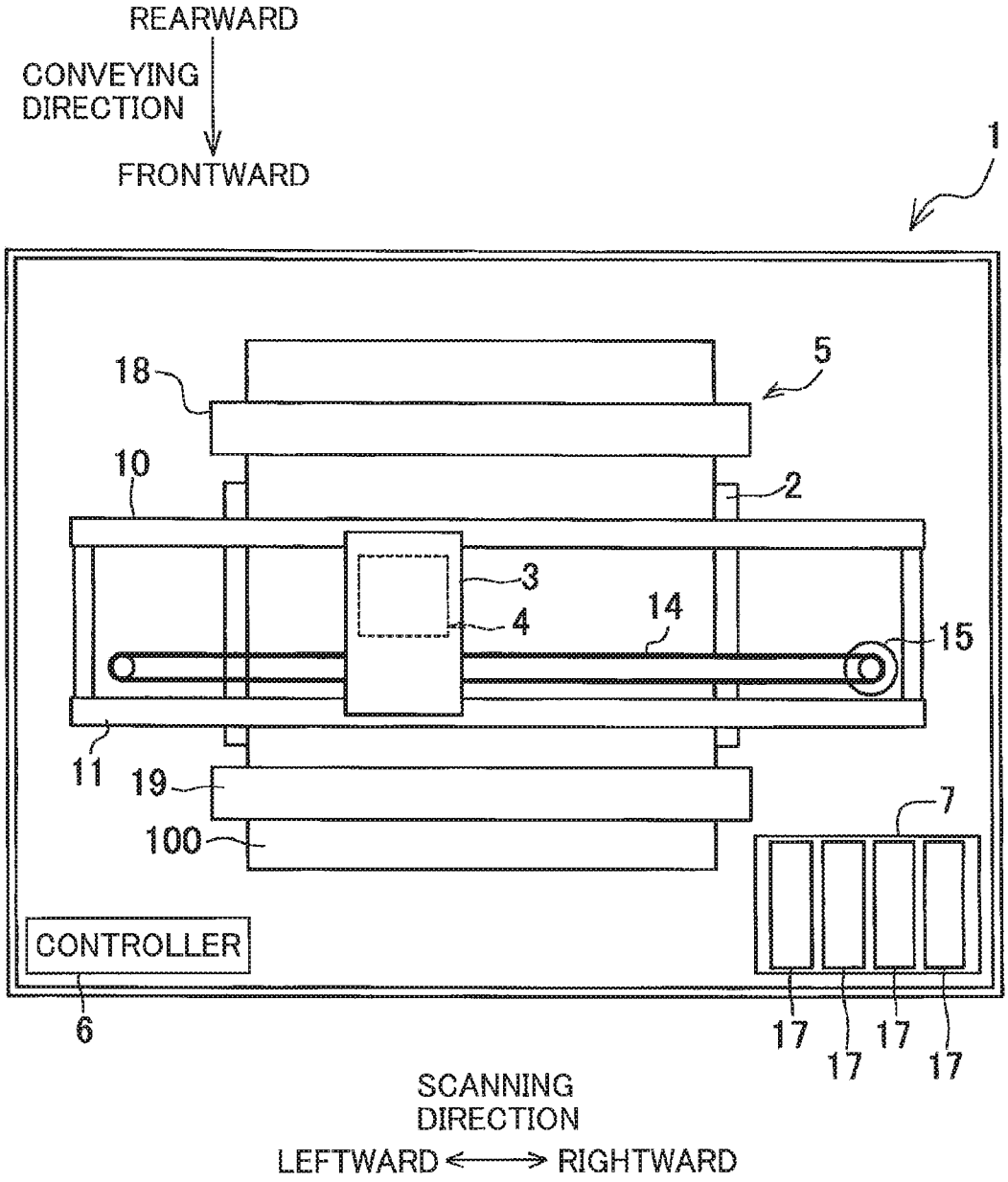
FIG. 1 is a schematic plan view of a printer according to one embodiment of the disclosure.

As shown in FIG. 1, a printer 1 according to the embodiment includes a platen 2, a carriage 3, an inkjet head 4, a conveying mechanism 5, a controller 6, and a cartridge holder 7.

The carriage 3 is mounted on two guide rails 10 and 11 extending in a scanning direction. The carriage 3 is connected to a carriage drive motor 15, via an endless belt 14. The carriage 3 is configured to be driven by the carriage drive motor 15 to reciprocate in the scanning direction above a recording sheet 100 supported on the platen 2. In the following description, a leftward direction and a rightward direction will be defined as shown in FIG. 1 based on the scanning direction.

The inkjet head 4 is mounted on the carriage 3. A plurality of nozzles 24 (see FIGS. 2-6) is formed in a bottom of the inkjet head 4. The inkjet head 4 is configured to move together with the carriage 3 in the scanning direction while ejecting ink from the nozzles 24 toward the recording sheet 100 supported on the platen 2. The cartridge holder 7 can accommodate four ink cartridges 17 accommodating ink in the four colors black, yellow, cyan, and magenta, respectively. Ink is supplied from each of the ink cartridges 17 to the inkjet head 4 through a corresponding tube (not shown).

The conveying mechanism 5 includes two conveying rollers 18 and 19 configured to convey the recording sheet 100 over the platen 2 in a conveying direction orthogonal to the scanning direction. In the following description, a frontward direction and a rearward direction are defined as shown in FIG. 1 based on the conveying direction.

The controller 6 is configured to control operations of the inkjet head 4, carriage drive motor 15, and the like based on print commands inputted from a personal computer or other external device in order to print images and the like on the recording sheet 100.

<Inkjet Head 4>

Next, a structure of the inkjet head 4 will be described in detail with reference to FIGS. 2 through 6. Note that a protective member 23 shown in FIG. 2 has been omitted from FIGS. 3 and 4.

The inkjet head 4 of the embodiment is configured to eject ink in all of the four colors described above (black, yellow, cyan, and magenta). As shown in FIGS. 2 through 6, the inkjet head 4 includes a nozzle plate 20, a channel member 21, and an actuator device 25 that includes a piezoelectric actuator 22. Note that the actuator device 25 in the embodiment does not simply designate the piezoelectric actuator 22, but conceptually includes the protective member 23 and wiring members called chip-on-films (COFs) 50 arranged on top of the piezoelectric actuator 22.

<Nozzle Plate 20>

The nozzle plate 20 is formed of silicon, for example. The nozzles 24 are formed in the nozzle plate 20 in rows extending in the conveying direction.

Figure 2:
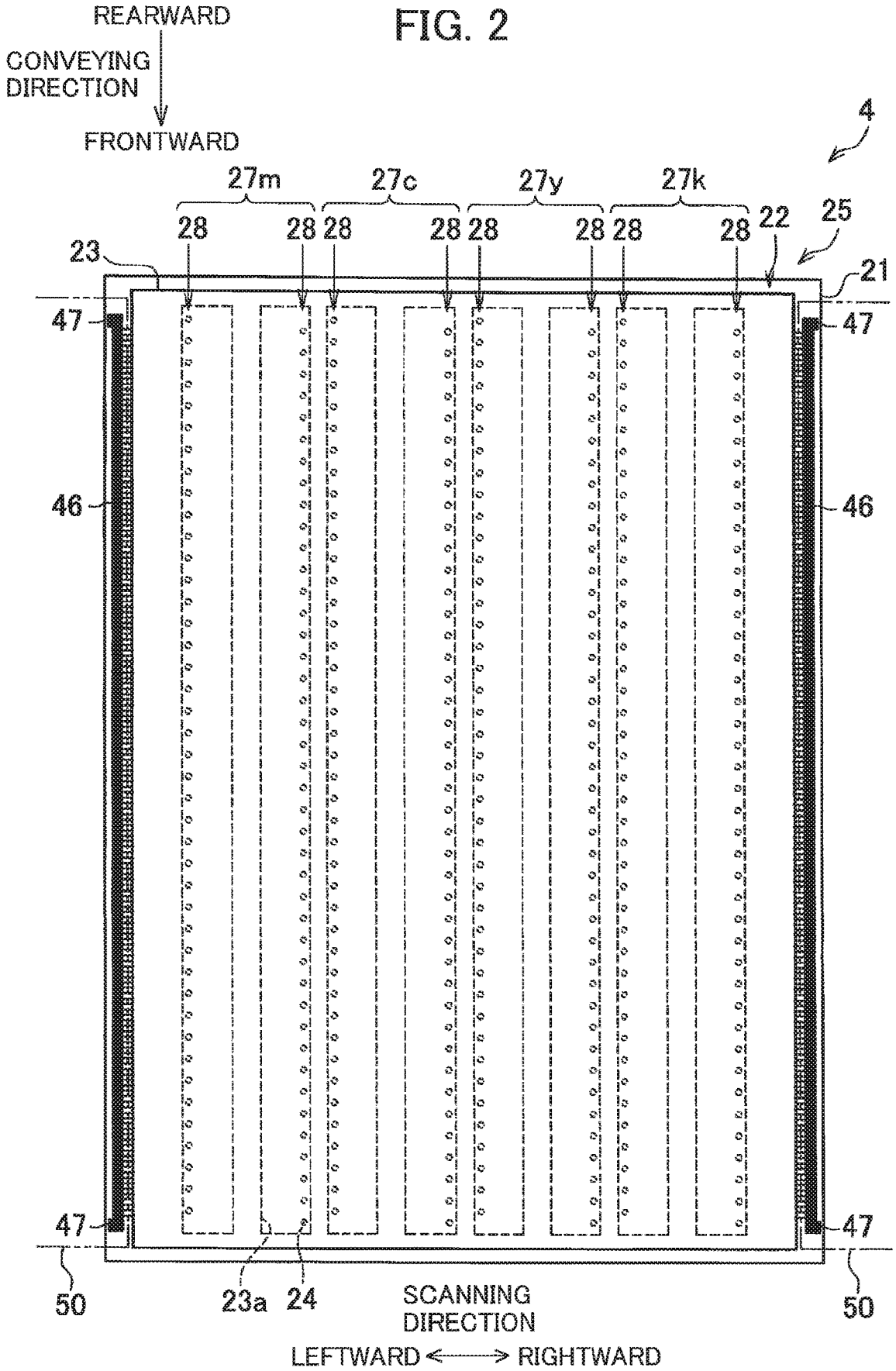
FIG. 2 is a plan view of an inkjet head of the printer according to the embodiment.
Figure 3:
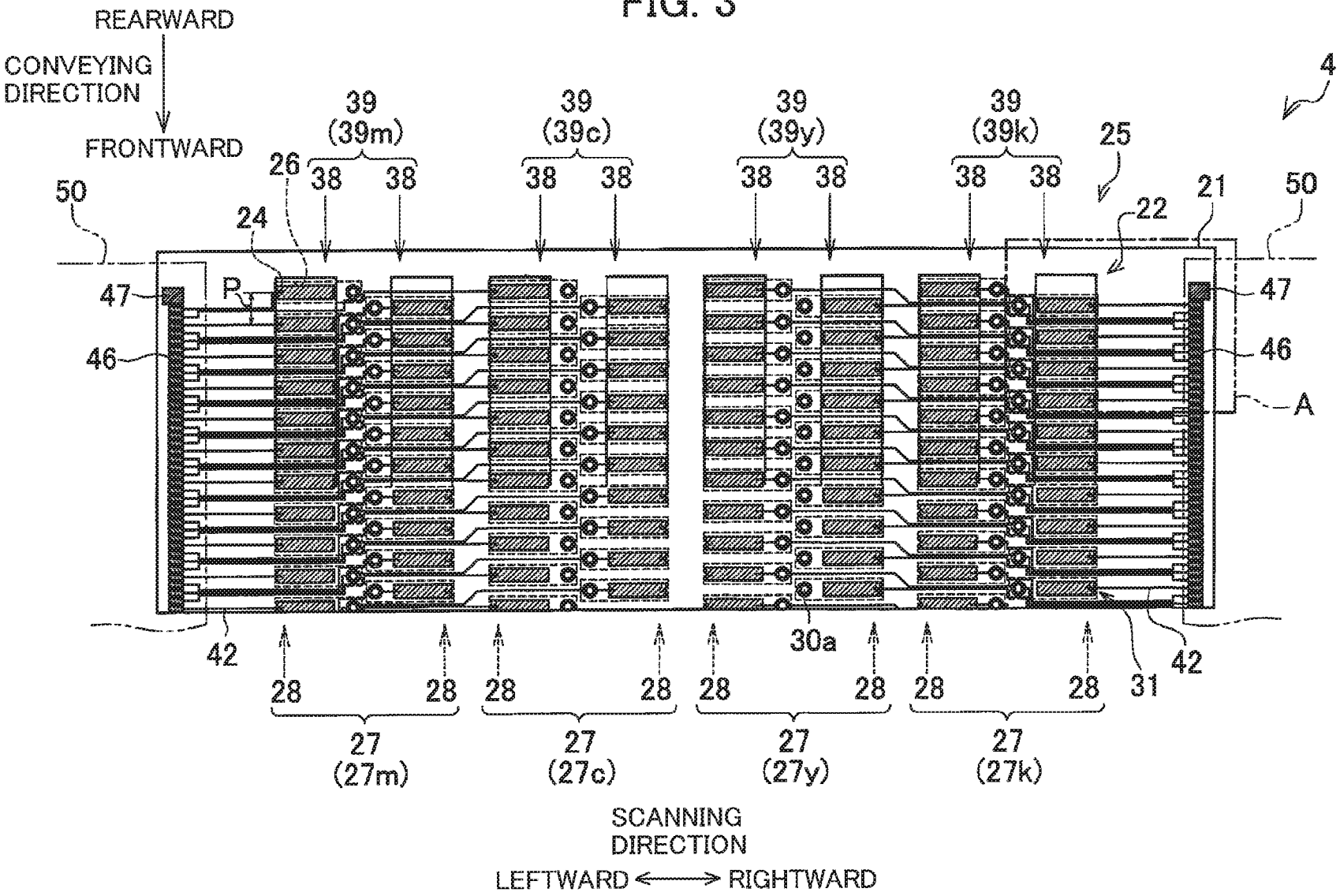
FIG. 3 is a partially enlarged view of a rear end portion of the inkjet head of FIG. 2.

More specifically, the nozzles 24 formed in the nozzle plate 20 are divided among four nozzle sets 27 juxtaposed in the scanning direction, as illustrated in FIGS. 2 and 3. Each of the four nozzle sets 27 ejects ink in a different color from the others. Each nozzle set 27 includes two left and right nozzle rows 28. The nozzles 24 in each nozzle row 28 are arranged at a pitch P in the conveying direction. Further, the positions of nozzles 24 in the two nozzle rows 28 of each nozzle set 27 are offset from each other in the conveying direction by P/2. In other words, the nozzles 24 constituting a single nozzle set 27 are arranged in two rows such that their positions in the conveying direction are staggered between rows.

When appropriate in the following description, one of the symbols "k" denoting black, "y" denoting yellow, "c" denoting cyan, and "m" denoting magenta will be appended to reference numerals assigned to components of the inkjet head 4 that are associated with the corresponding ink color black (K), yellow (Y), cyan (C), and magenta (M). For example, a nozzle set 27*k* denotes the nozzle set 27 that ejects black ink.

<Channel Member 21>

The channel member 21 is a single-crystal silicon substrate. As shown in FIGS. 2 through 6, a plurality of pressure chambers 26 is formed in the channel member 21. Each pressure chambers 26 is communication with one of the plurality of nozzles 24. Each of the pressure chambers 26 has a rectangular planar shape that is elongated in the scanning direction. The pressure chambers 26 are arranged in two rows for each ink color, for a total of eight pressure chamber rows, with pressure chambers 26 in each row juxtaposed in the conveying direction at positions corresponding to the nozzles 24. The channel member 21 has a bottom surface that is covered by the nozzle plate 20. Further, an outer end of each pressure chamber 26 in the scanning direction corresponding to the same color overlaps one of the nozzles 24 vertically.

Each pressure chamber 26 has a length L in the scanning direction of approximately 500-1000 μm, a width W (dimension in the conveying direction) of approximately 65 μm, and a depth D of approximately 125 μm (between 50 and 150 μm). Thus, the ratio of the depth D to the width W of the pressure chamber 26 in the embodiment is approximately two times (between one and three times).

Here, the length L of the pressure chamber 26 in the scanning direction is a distance between both inner wall surfaces of the pressure chamber 26 in the scanning direction. Further, the width W of the pressure chamber 26 is a distance between both inner wall surfaces of the pressure chamber 26 in the conveying direction. A vertical dimension of the pressure chamber 26 varies in different areas of the pressure chamber 26 due to deflection of a vibrating film 30 (described later) formed over a top surface of the pressure chamber 26. Accordingly, the depth D of the pressure chamber 26 described herein designates a distance between a top surface of the nozzle plate 20 and a surface of the vibrating film 30 on the pressure chamber 26 side (bottom surface) in a region between neighboring pressure chambers 26 (a non-deflected area).

Note that a single vibrating film 30 constituting a component of the piezoelectric actuator 22 described later is arranged on the top surface of the channel member 21 so as to cover the plurality of pressure chambers 26. The vibrating film 30 has no particular limitations and may be any insulating film that covers the pressure chambers 26. In the present embodiment, the vibrating film 30 is formed by oxidizing or nitriding a surface of a silicon substrate, for example. Ink supply holes 30*a* are formed in areas of the vibrating film 30 that cover inner ends of the pressure chambers 26 in the scanning direction (the ends opposite the nozzles 24). The vibrating film 30 has a thickness E1 of approximately 1-3 μm. Here, the thickness E1 of the vibrating film 30 designates a distance between the surface of the vibrating film 30 on the channel member 21 side (bottom surface) and a surface of the vibrating film 30 opposite the channel member 21 (top surface).

<Actuator Device 25>

The actuator device 25 is arranged on the top surface of the channel member 21. As mentioned earlier, the actuator device 25 includes the piezoelectric actuator 22 that includes a plurality of piezoelectric elements 31, the protective member 23, and two COFs 50.

Figure 4:
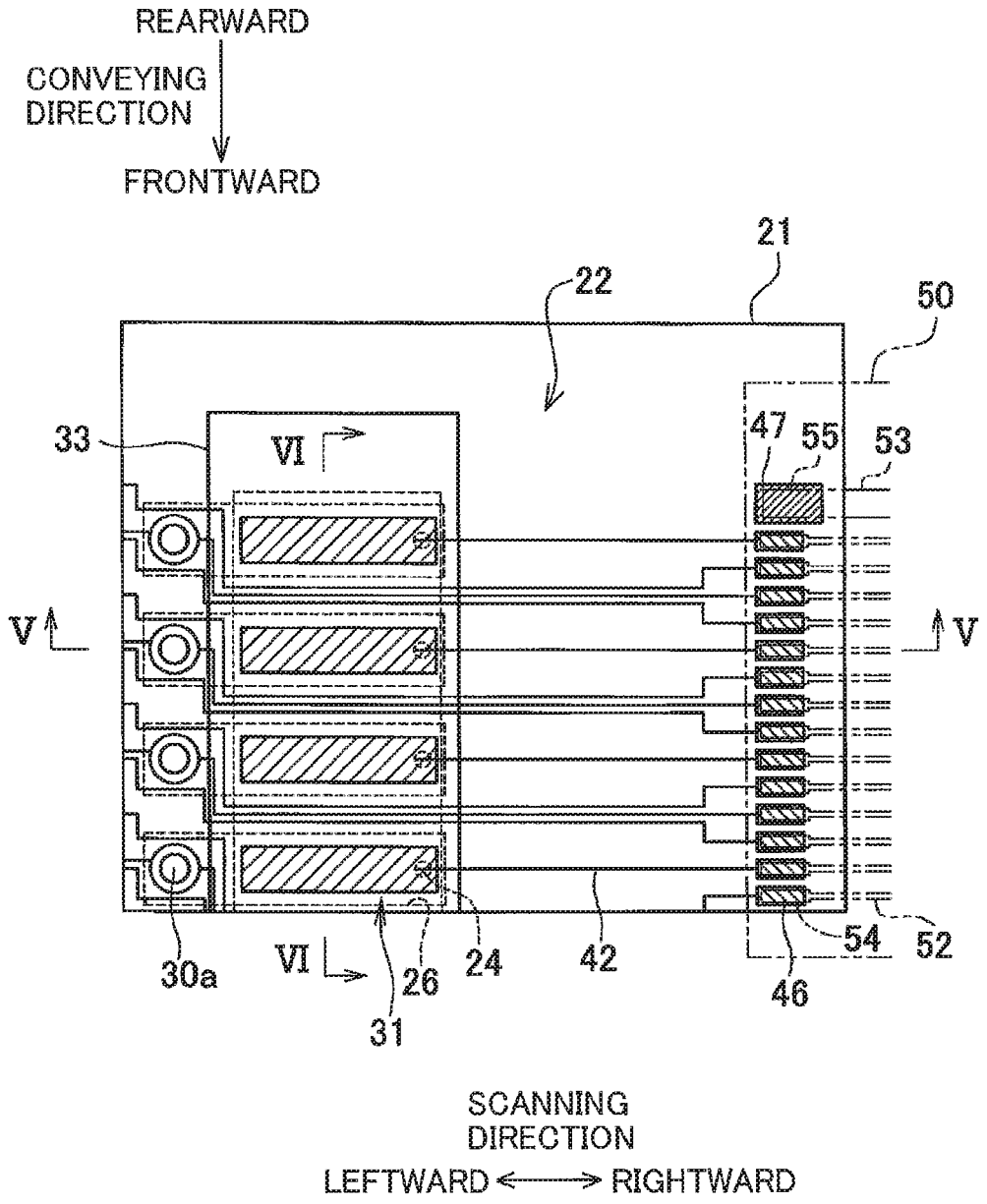
FIG. 4 is an enlarged view of a portion A enclosed by a phantom line in FIG. 3.

The piezoelectric actuator 22 is arranged over the entire top surface of the channel member 21. As shown in FIGS. 3 and 4, the piezoelectric actuator 22 includes a plurality of the piezoelectric elements 31 arranged each at a position overlapping a corresponding one of the plurality of pressure chambers 26. The piezoelectric elements 31 configure eight piezoelectric element rows 38. The piezoelectric elements 31 in each piezoelectric element row 38 are juxtaposed in the conveying direction at positions conforming to the positions of the pressure chambers 26. A plurality of drive contacts 46 and two ground contacts 47 are led leftward from the four piezoelectric element rows 38 on the left side. These contacts 46 and 47 are arranged along a left edge of the channel member 21, as illustrated in FIGS. 2 and 3. Similarly, a plurality of drive contacts 46 and two ground contacts 47 are led rightward from the four piezoelectric element rows 38 on the right side and are arranged along a right edge of the channel member 21. A detailed structure of the piezoelectric actuator 22 will be described later.

The protective member 23 is arranged over a top surface of the piezoelectric actuator 22 so as to cover the piezoelectric elements 31. Specifically, the protective member 23 has eight concave protection areas 23*a* that individually cover the corresponding eight piezoelectric element rows 38. Note that the protective member 23 does not cover left and right edges of the piezoelectric actuator 22. Consequently, the drive contacts 46 and ground contacts 47 are exposed outside the protective member 23, as shown in FIG. 2. The protective member 23 also has four reservoirs 23*b* that are to be connected respectively to the four ink cartridges 17 in the cartridge holder 7. Ink in the reservoirs 23*b* is supplied to the corresponding pressure chambers 26 along ink supply channels 23*c* (FIG. 5) and through the ink supply holes 30*a* formed in the vibrating film 30.

The COFs 50 shown in FIGS. 2-5 are flexible wiring members. Each COF 50 has a circuit board 56 formed of an electrically insulating material, such as polyimide film. A driver IC 51 is mounted on the circuit board 56. One end of each COF 50 is connected to the controller 6 provided in the printer 1 (see FIG. 1), while the other end is connected to the corresponding left or right end of the piezoelectric actuator 22. As shown in FIG. 4, each COF 50 includes a plurality of individual wires 52 that are connected to the driver IC 51, and two ground wires 53. An individual contact 54 is provided on a leading end of each individual wire 52. The individual contacts 54 connect with corresponding drive contacts 46 on the piezoelectric actuator 22. A ground connection contact 55 is provided on a leading end of each ground wire 53. The ground connection contacts 55 connect with corresponding ground contacts 47 on the piezoelectric actuator 22. The driver IC 51 is configured to output individual drive signals to each of the piezoelectric elements 31 in the piezoelectric actuator 22 via the individual contacts 54 and drive contacts 46.

<Piezoelectric Actuator 22>

Next, the piezoelectric actuator 22 will be described in greater detail. As shown in FIGS. 2 through 6, the piezoelectric actuator 22 includes, in addition to the vibrating film 30 described above, a common electrode 36 (a plurality of first electrodes 32), piezoelectric films 33, and a plurality of second electrodes 34. Note that protective films 40, insulating films 41, and wiring protective films 43 shown in the cross-sectional views of FIGS. 5 and 6 have been omitted from FIGS. 3 and 4 for simplification.

Figure 5:
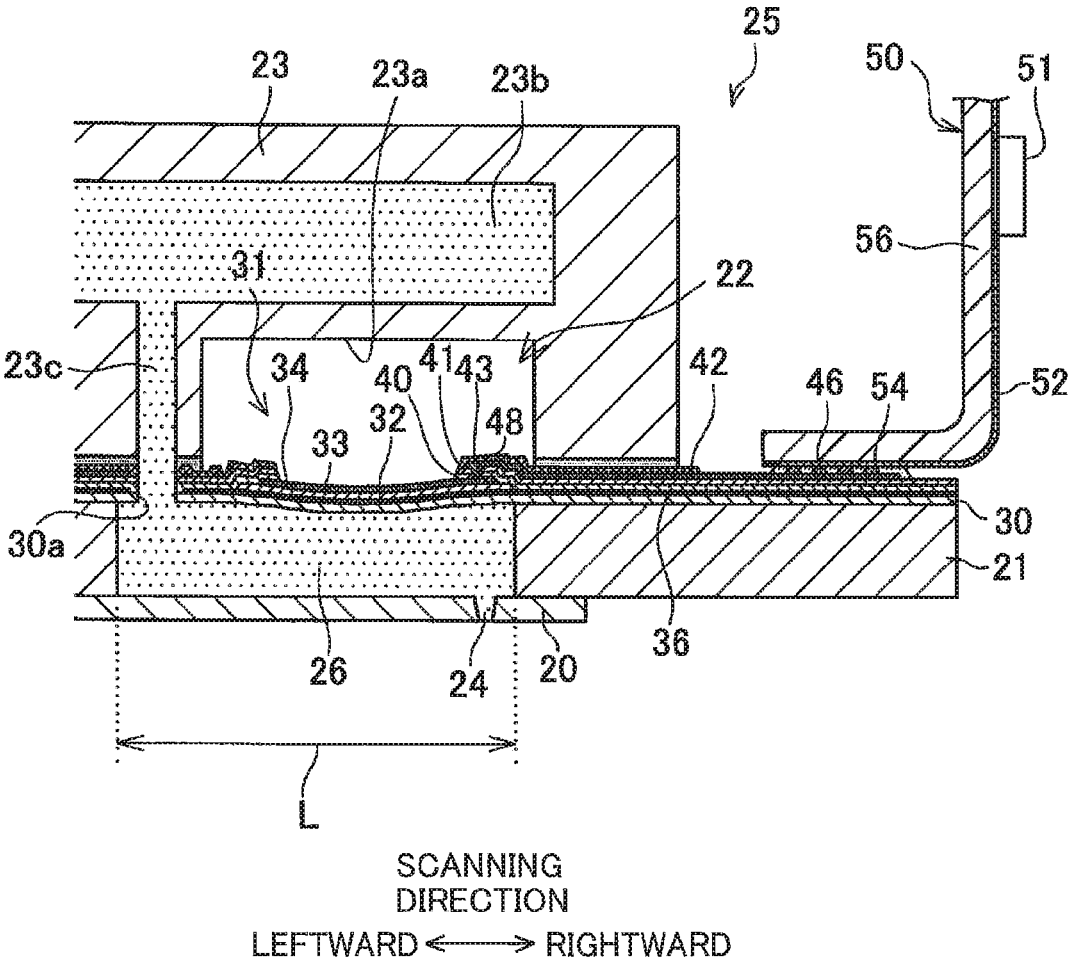
FIG. 5 is a cross-sectional view of a portion taken along a line V-V in FIG. 4.
Figure 6:
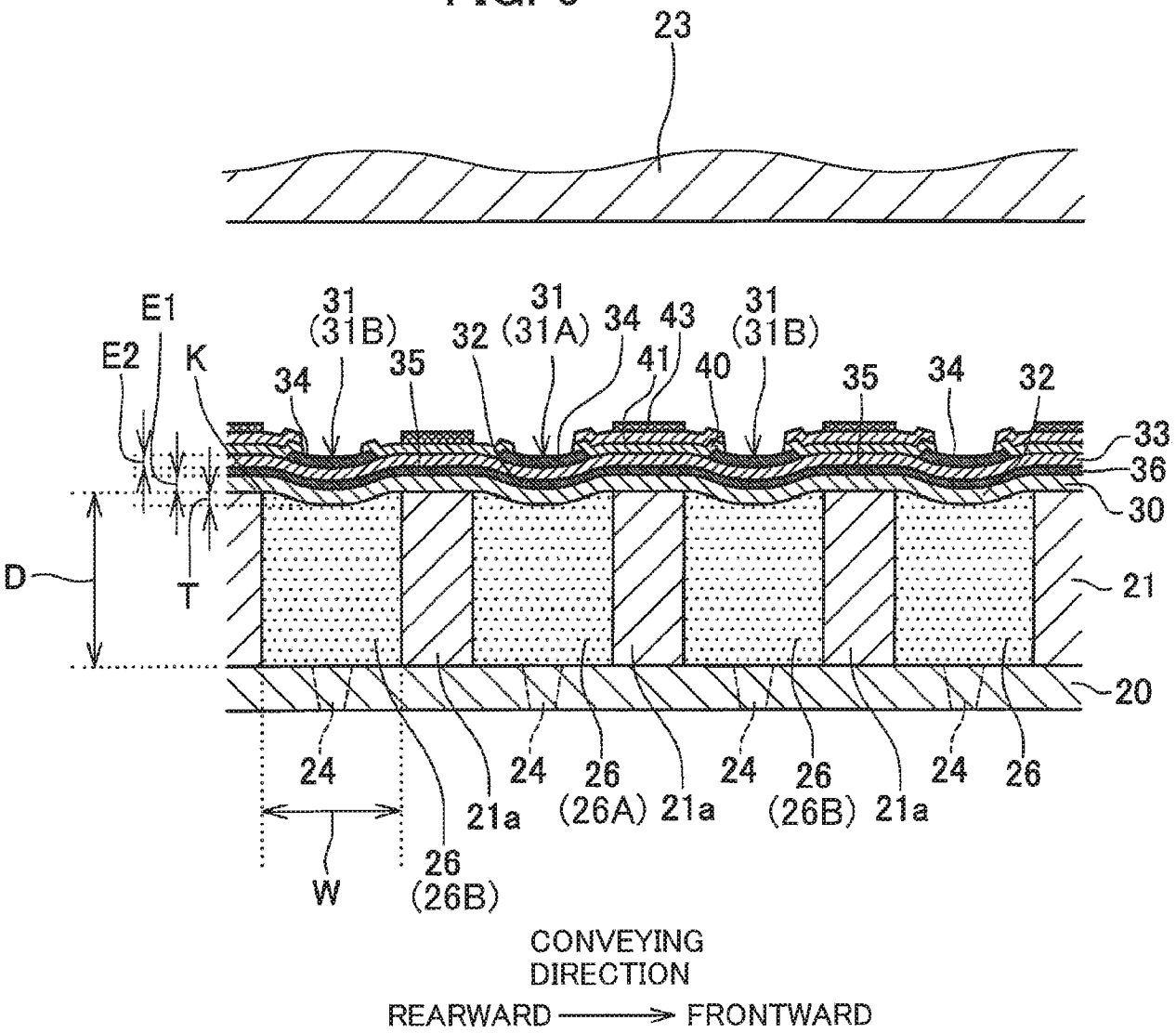
FIG. 6 is a cross-sectional view of a portion taken along a line VI-VI in FIG. 4.

As shown in FIGS. 5 and 6, the first electrodes 32 are formed in areas on the top surface of the vibrating film 30 opposite the pressure chambers 26. As shown in FIG. 6, the first electrodes 32 are connected via conductive parts 35 arranged on the top surface of the vibrating film 30 in areas not vertically overlapping the pressure chambers 26. Connecting the plurality of first electrodes 32 via the conductive parts 35 in this way forms the common electrode 36 so as to cover substantially the entire top surface of the vibrating film 30. The common electrode 36 is formed of platinum (Pt), for example, and has a thickness of 0.1 μm, for example.

The piezoelectric films 33 are formed of a piezoelectric material, such as PZT. Alternatively, the piezoelectric films 33 may be formed of a lead-free piezoelectric material. The piezoelectric films 33 have a thickness E2 that is smaller than the thickness E1 of the vibrating film 30, such as 1.0-2.0 μm (less than or equal to 2.0 μm). Here, the thickness E2 of the piezoelectric films 33 denotes a distance between a surface of the piezoelectric film 33 on the vibrating film 30 side (bottom surface) and a surface of the piezoelectric film 33 on a side opposite the vibrating film 30 (top surface).

As shown in FIGS. 3, 4, and 6, the piezoelectric films 33 are arranged on the top surface of the vibrating film 30 over which the common electrode 36 is formed. One piezoelectric film 33 is provided for each pressure chamber row and extends in the conveying direction across the plurality of pressure chambers 26 constituting the pressure chamber row 38. There are eight piezoelectric films 33 in total.

The second electrodes 34 are arranged on the top surfaces of the piezoelectric films 33 each at a position corresponding to a corresponding one of the pressure chambers 26. The second electrodes 34 have a rectangular planar shape that is slightly smaller than the pressure chambers 26 and vertically overlap center regions of the corresponding pressure chambers 26. Unlike the first electrodes 32, the second electrodes 34 are separated from one another. In other words, the second electrodes 34 are individual electrodes provided individually for each of the pressure chambers 26. The second electrodes 34 are formed of iridium (Ir) or platinum (Pt), for example. The second electrodes 34 has a thickness of 0.1 μm, for example. The second electrodes 34 are formed according to a sputtering method described later and possess compressive stress.

Further, a portion of each piezoelectric film 33 interposed between one first electrode 32 and one second electrode 34 is polarized so that a ratio of (001) orientation to (100) orientation in the piezoelectric film 33 is 50% or greater. The orientation ratio in the piezoelectric film 33 is more preferably at least 80%.

In the piezoelectric actuator 22 described above, the second electrodes 34 have compressive stress, and the ratio of (001) orientation to (100) orientation in the piezoelectric film 33 is 50% or greater. With this piezoelectric actuator 22, the portions of the vibrating film 30 and piezoelectric films 33 vertically overlapping the pressure chambers 26 (the portions forming the piezoelectric elements 31) are convexly deflected toward the pressure chambers 26 while a potential difference is not produced between the first electrodes 32 and second electrodes 34. The vibrating film 30 and piezoelectric films 33 at this time provide a deflection amount T of approximately 450 nm (between 400 and 500 nm). Here, the deflection amount T denotes a vertical distance between a border K at which the side wall surface of the pressure chamber 26 meets the vibrating film 30, and a point on the bottom surface of the vibrating film 30 that vertically overlaps a center of the pressure chamber 26 in the conveying direction (see FIG. 6).

In the piezoelectric actuator 22 having this configuration, the portions of the vibrating film 30 and piezoelectric films 33 vertically overlapping each pressure chamber 26, and the first electrode 32 and second electrode 34 vertically overlapping this portion of the piezoelectric film 33 together form one piezoelectric element 31. Hence, a plurality of the piezoelectric elements 31 is juxtaposed in the conveying direction in conformance with the juxtaposition of the pressure chambers 26. Accordingly, in conformance with the arrangement of nozzles 24 and pressure chambers 26, the piezoelectric elements 31 configure two piezoelectric element rows 38 for each color of ink, making a total of eight piezoelectric element rows 38. Here, a set of piezoelectric elements 31 forming two piezoelectric element rows 38 for one color of ink will be called a piezoelectric element set 39. As shown in FIG. 3, four piezoelectric element sets 39*k*, 39*y*, 39*c*, and 39*m* corresponding to the four ink colors are juxtaposed in the scanning direction.

As shown in FIGS. 5 and 6, the piezoelectric actuator 22 further includes the protective films 40, the insulating films 41, wires 42, and the wiring protective films 43.

As shown in FIG. 5, the protective films 40 are arranged so as to cover the top surfaces of the corresponding piezoelectric films 33, excluding regions corresponding to center portions of the second electrodes 34. A primary function of the protective film 40 is to prevent moisture in the air from entering the piezoelectric film 33. The protective film 40 is formed of a material having low water permeability. For example, the protective film 40 may be formed of an oxide such as alumina ($Al_2O_3$), silicon oxide ($SiO_x$), tantalum oxide ($TaO_x$), or the like; or a nitride such as silicon nitride (SiN).

The insulating films 41 are formed over the tops of respective protective films 40. While there are no particular limitations on the type of material used to form the insulating film 41, the insulating film 41 may be formed of silicon dioxide ($SiO_2$), for example. The insulating film 41 serves to enhance the insulating properties between the wires 42 (described next) connected to the second electrodes 34, and the common electrode 36.

A plurality of the wires 42 is formed on the insulating films 41. The wires 42 are lead out from the second electrodes 34 in the plurality of piezoelectric elements 31. The wires 42 are formed of aluminum (Al), for example. As shown in FIG. 5, one end of each wire 42 is arranged in a position overlapping an end of the corresponding second electrode 34 on top of the piezoelectric film 33 and is electrically connected to the corresponding second electrode 34 by a through conductive part 48 penetrating the protective film 40 and insulating film 41.

The wires 42 can be divided into those that extend leftward from the piezoelectric elements 31 and those that extend rightward. Specifically, among the four piezoelectric element sets 39 shown in FIG. 3, the wires 42 extend rightward from the piezoelectric elements 31 constituting the two piezoelectric element sets 39*k* and 39*y* on the right side and extend leftward from the piezoelectric elements 31 constituting the two piezoelectric element sets 39*c* and 39*m* on the left side.

The drive contacts 46 are provided each on another end of the wire 42 opposite the end connected to the second electrode 34. A plurality of the drive contacts 46 is arranged in a row extending in the conveying direction on both the left and right edges of the piezoelectric actuator 22. In the present embodiment, the nozzles 24 constituting a nozzle set 27 for one color are arranged at a pitch of 600 dpi (equivalent to 42 μm). Further, the wires 42 are drawn out either leftward or rightward from the piezoelectric elements 31 corresponding to the nozzle sets 27 for two colors. Consequently, the drive contacts 46 on both the left and right edges of the piezoelectric actuator 22 are arranged at an extremely narrow pitch that is half the pitch of the nozzles 24 in a single nozzle set 27, or approximately 21 μm.

Further, the two ground contacts 47 are arranged on ends of each row of drive contacts 46, with one on the front end and one on the rear end. One ground contact 47 has a greater contact area than one drive contact 46. The ground contacts 47 are connected to the common electrode 36 through conductive parts (not shown) penetrating the protective films 40 and insulating films 41 directly beneath the ground contacts 47.

As mentioned above, the drive contacts 46 and ground contacts 47 arranged on the left and right edges of the piezoelectric actuator 22 are exposed outside the protective member 23. The COFs 50 are also bonded to the left and right edges of the piezoelectric actuator 22. The drive contacts 46 are connected to the driver IC 51 of the corresponding COF 50 via the individual contacts 54 and individual wires 52, and drive signals are supplied to the drive contacts 46 from the driver IC 51. With this configuration, the driver IC 51 can selectively apply either a ground potential or a prescribed drive potential (approximately 20V, for example) to each of the second electrodes 34 individually. A ground potential is applied by connecting the ground contacts 47 to the ground connection contacts 55 of the COFs 50.

As shown in FIG. 5, the wiring protective films 43 are arranged so as to cover the wires 42. The wiring protective films 43 improve the insulation between adjacent wires 42. The wiring protective films 43 also suppress oxidation of the wiring material (aluminum, etc.) constituting the wires 42. The wiring protective films 43 are formed of silicon nitride ($SiN_x$), for example.

Note that except for their peripheral edges, the second electrodes 34 are exposed in the protective films 40, insulating films 41, and wiring protective films 43 in the embodiment, as illustrated in FIGS. 5 and 6. In other words, the protective films 40, insulating films 41, and wiring protective films 43 are configured so as not to hinder deformation of the piezoelectric films 33.

<Method of Driving the Piezoelectric Actuator 22>

Next, a method of driving the piezoelectric actuator 22 (the piezoelectric elements 31) to eject ink from the nozzles 24 will be described.

Initially, the second electrodes 34 in all piezoelectric elements 31 of the piezoelectric actuator 22 are maintained at a drive potential. In this state, the potential difference between the first electrodes 32 and second electrodes 34 produces an electric field along a thickness of the piezoelectric film 33 that causes the piezoelectric film 33 to contract in a direction orthogonal to a thickness direction thereof. Consequently, the portions of the vibrating film 30 and piezoelectric films 33 that vertically overlap the pressure chambers 26 deflect convexly toward the pressure chamber 26 side (downward), and the amount of this deflection is greater than when a potential difference is not produced between the first electrodes 32 and second electrodes 34. Since the piezoelectric films 33 of the embodiment are thin, having a thickness of approximately 1.0-2.0 μm, a large electric field is generated in the piezoelectric films 33, producing a large deflection amount in the vibrating film 30 and piezoelectric films 33.

To eject ink from a certain nozzle 24, the potential of the second electrode 34 in the piezoelectric element 31 corresponding to that nozzle 24 is temporarily switched to the ground potential and then returned to the drive potential. When the potential of the second electrode 34 is switched to the ground potential, the first electrode 32 and second electrode 34 have the same potential, eliminating the electric field and thereby reducing the amount of deflection in the vibrating film 30 and piezoelectric film 33. When the potential of the second electrode 34 is subsequently returned to the drive potential, the deflection amount of the vibrating film 30 and piezoelectric film 33 increases, reducing a capacity of the pressure chamber 26. The reduction in capacity increases the pressure of ink in the pressure chamber 26, causing ink to be ejected from the nozzle 24 that communicates with the pressure chamber 26.

<Crosstalk>

Here, a phenomenon called crosstalk (displacement crosstalk and ejection crosstalk) may occur when driving the piezoelectric actuator 22. According to this phenomenon, the drive of the piezoelectric element 31 corresponding to a certain pressure chamber 26 affects the ejection speed of ink from a nozzle 24 communicating with a separate pressure chamber 26. This phenomenon of crosstalk will be described next in greater detail.

For this description of crosstalk, one pressure chamber 26 will be called a pressure chamber 26A, and the piezoelectric element 31 corresponding to the pressure chamber 26A will be called a piezoelectric element 31A, as illustrated in FIG. 6. Further, the two pressure chambers 26 adjacent to the pressure chamber 26A on both sides in the conveying direction will be called pressure chambers 26B, and the piezoelectric elements 31 corresponding to the pressure chambers 26B will be called piezoelectric elements 31B.

When the drive potential is applied to the second electrodes 34 in the piezoelectric elements 31B, the portions of the vibrating film 30 forming the piezoelectric elements 31B are deflected, as described above. While the portions of the vibrating film 30 forming the piezoelectric elements 31B are deflected, tensile stress is generated in the portion of the vibrating film 30 forming the piezoelectric element 31A. This tensile stress causes the portion of the vibrating film 30 forming the piezoelectric element 31A to elongate and urges the portions of the vibrating film 30 and piezoelectric film 33 forming the piezoelectric element 31A to deform convexly toward the pressure chambers 26A.

Further, when numerous pressure chambers 26 are arranged densely in the conveying direction, partitioning walls 21*a* of the channel member 21 that separate neighboring pressure chambers 26 have a narrow dimension in the conveying direction. In this case, while the portions of the vibrating film 30 forming the piezoelectric elements 31B are deflected as described above, the partitioning walls 21*a* between the pressure chamber 26A and pressure chambers 26B are susceptible to collapsing toward the pressure chamber 26B side from the pull of the vibrating film 30. As a consequence, the portion of the vibrating film 30 forming the piezoelectric element 31A tends to deform in a direction toward a flat state.

Owing to these phenomena, when the potential of the second electrode 34 in the piezoelectric element 31A is switched as described above in order to eject ink from the nozzle 24 in communication with the pressure chamber 26A, the portions of the vibrating film 30 and piezoelectric film 33 vertically overlapping the pressure chamber 26A have a different amount of deformation when the potential of the second electrodes 34 in the piezoelectric elements 31B is switched simultaneously than when the potential is not switched simultaneously. This difference in the amount of deformation produces a difference in the ejection speed of ink ejected from the nozzle 24 and is called displacement crosstalk.

Here, we will consider a case different from the embodiment in which the portions of the vibrating film 30 and piezoelectric film 33 forming the piezoelectric elements 31 deflect convexly toward the side opposite the pressure chambers 26 while a potential difference is not being produced between the first electrodes 32 and second electrodes 34. In this case, the portions of the vibrating film 30 and piezoelectric film 33 forming the piezoelectric element 31A are inclined to deform in a direction to be convex toward the pressure chamber 26A owing to the tensile stress described above. Further, when the partitioning walls 21*a* are prone to collapse, the portions of the vibrating film 30 and piezoelectric film 33 forming the piezoelectric element 31A are inclined to deform in a direction for flattening out (the direction for forming a convex shape on the pressure chamber 26 side). In other words, the direction in which the portions of the vibrating film 30 and piezoelectric film 33 that form the piezoelectric element 31A are inclined to deform due to the tensile stress and the direction in which the portions of the vibrating film 30 and piezoelectric film 33 forming the piezoelectric element 31A are inclined to deform when the partitioning walls 21*a* are prone to collapse are the same direction. Consequently, forces tending to deform these parts are added together when driving the piezoelectric actuator 22 in this case, thereby increasing displacement crosstalk.

Now let's consider a case similar to that of the embodiment in which the portions of the vibrating film 30 and piezoelectric film 33 forming the piezoelectric elements 31 deflect convexly toward the pressure chamber 26 side while a potential difference is not being produced between the first electrodes 32 and second electrodes 34. In this case, the portions of the vibrating film 30 and piezoelectric film 33 forming the piezoelectric element 31A are inclined to be deformed by the tensile stress described above in a direction for forming a convex shape on the pressure chamber 26 side. Further, when the partitioning walls 21*a* are prone to collapse, the portions of the vibrating film 30 and piezoelectric film 33 forming the piezoelectric element 31A are inclined to deform in a direction for flattening out (a direction toward forming a convex shape on the side opposite the pressure chamber 26). In other words, the direction in which the portions of the vibrating film 30 and piezoelectric film 33 forming the piezoelectric element 31A are inclined to deform due to the tensile stress is opposite the direction in which the portions of the vibrating film 30 and piezoelectric film 33 forming the piezoelectric element 31A are inclined to deform when the partitioning walls 21*a* are prone to collapse. Thus, the forces acting to deform these parts cancel each other in this case, reducing displacement crosstalk.

Further, as the dimension of the partitioning walls 21*a* in the conveying direction is shorter and the depth of the pressure chambers 26 is greater (the vertical length of the partitioning walls 21*a* is longer), the partitioning walls 21*a* are more susceptible to deformation (have greater compliance) in response to fluctuations in ink pressure in the pressure chambers 26. Accordingly, the partitioning walls 21*a* having higher compliance is more likely to deform when the piezoelectric element 31 is driven as described above to apply pressure to ink in a pressure chamber 26, and the pressure fluctuation caused by the deformation of the partitioning walls 21*a* is transmitted to other pressure chambers 26. If the piezoelectric element 31A and piezoelectric elements 31B are driven simultaneously, ink pressure in the pressure chamber 26A and ink pressure in the pressure chambers 26B will fluctuate at the same time, inhibiting deformation of the partitioning walls 21*a* and thus inhibiting the transmission of pressure fluctuations described above. On the other hand, if the piezoelectric element 31B is not driven at the same time as the piezoelectric element 31A is driven, pressure fluctuations in the pressure chamber 26A are readily transmitted to the pressure chamber 26B. This difference in how pressure fluctuations are transmitted together with the displacement crosstalk described above cause variations in the speed at which ink is ejected from the nozzles 24 called ejection crosstalk.

<Method of Manufacturing the Inkjet Head>

Next, a method of manufacturing the inkjet head 4 will be described. The inkjet head 4 can be manufactured according to a procedure following a flowchart in FIG. 7, for example.

Figure 7:
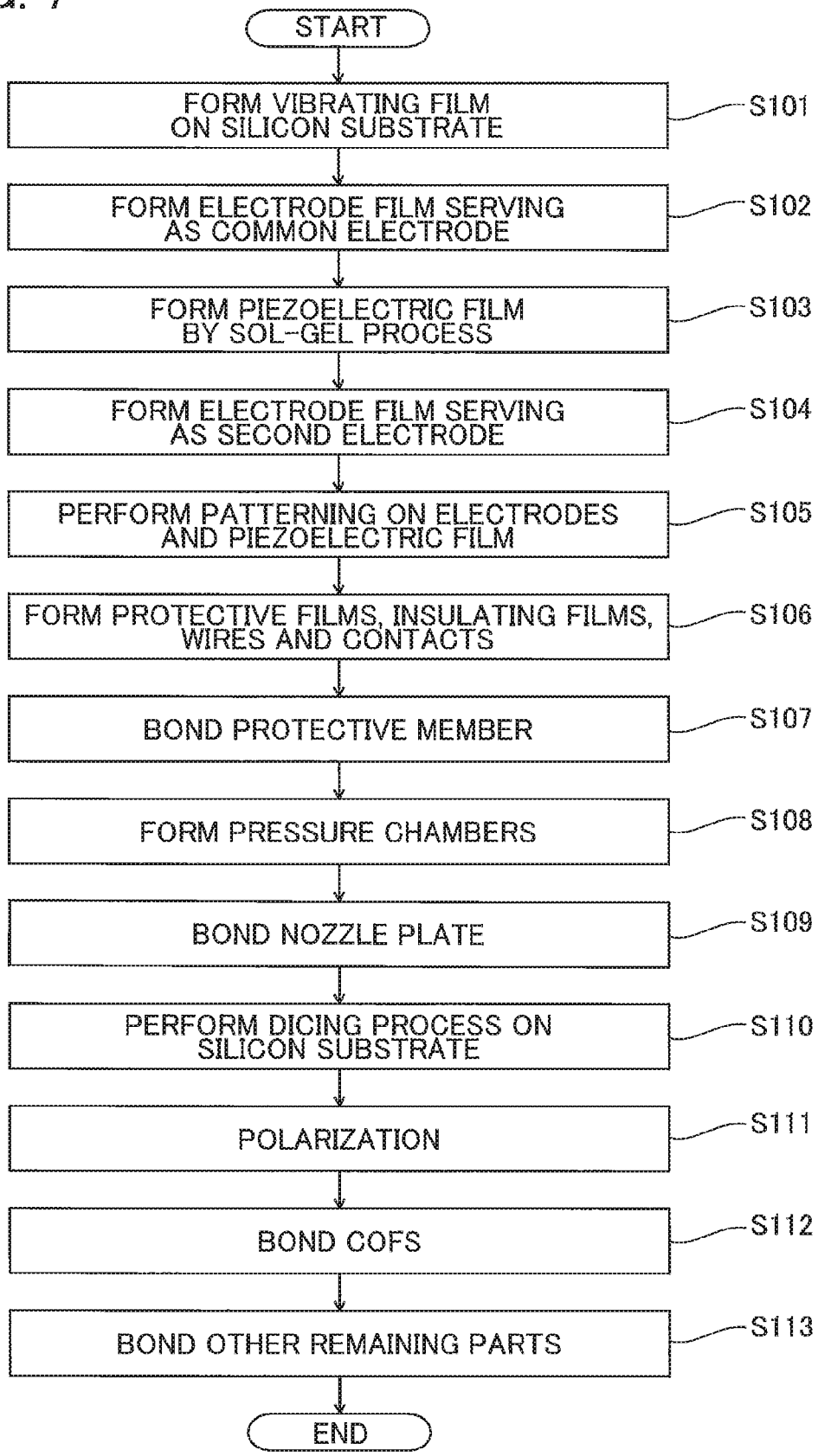
FIG. 7 is a flowchart illustrating steps in manufacturing the inkjet head according to a second embodiment.

Here, the steps in the flowchart of FIG. 7 will be described in detail.

In S101 at the beginning of the process for manufacturing the inkjet head 4, the vibrating film 30 is formed on a silicon substrate, which will become the channel member 21. The vibrating film 30 is formed by oxidizing or nitriding the surface of the silicon substrate. In S102 an electrode film that will serve as the common electrode 36 (the first electrodes 32) is formed over the top surface of the vibrating film 30.

In S103, a piezoelectric material film that will become the piezoelectric film 33 is formed over the top surface of the electrode film. The piezoelectric material film is formed according to the sol-gel process. More specifically, the piezoelectric material film is formed by repeatedly performing steps for forming the piezoelectric material by spin coating a solution of the material and then crystalizing the piezoelectric material through an annealing process.

In S104 an electrode film that will become the second electrodes 34 is formed on the top surface of the piezoelectric material film. This electrode film is formed by sputtering or the like, at which time the conditions are controlled so that the electrode film will possess compressive stress.

In S105, the common electrode 36 (first electrodes 32), piezoelectric films 33, and second electrodes 34 are formed by patterning the electrode film and piezoelectric film formed in the preceding steps using photolithography, dry etching, and the like. Thereafter, the protective films 40, insulating films 41, wires 42, wiring protective films 43, drive contacts 46, and ground contacts 47 are sequentially formed in S106 and the protective member 23 is bonded to the silicon substrate in S107.

Figure 8:
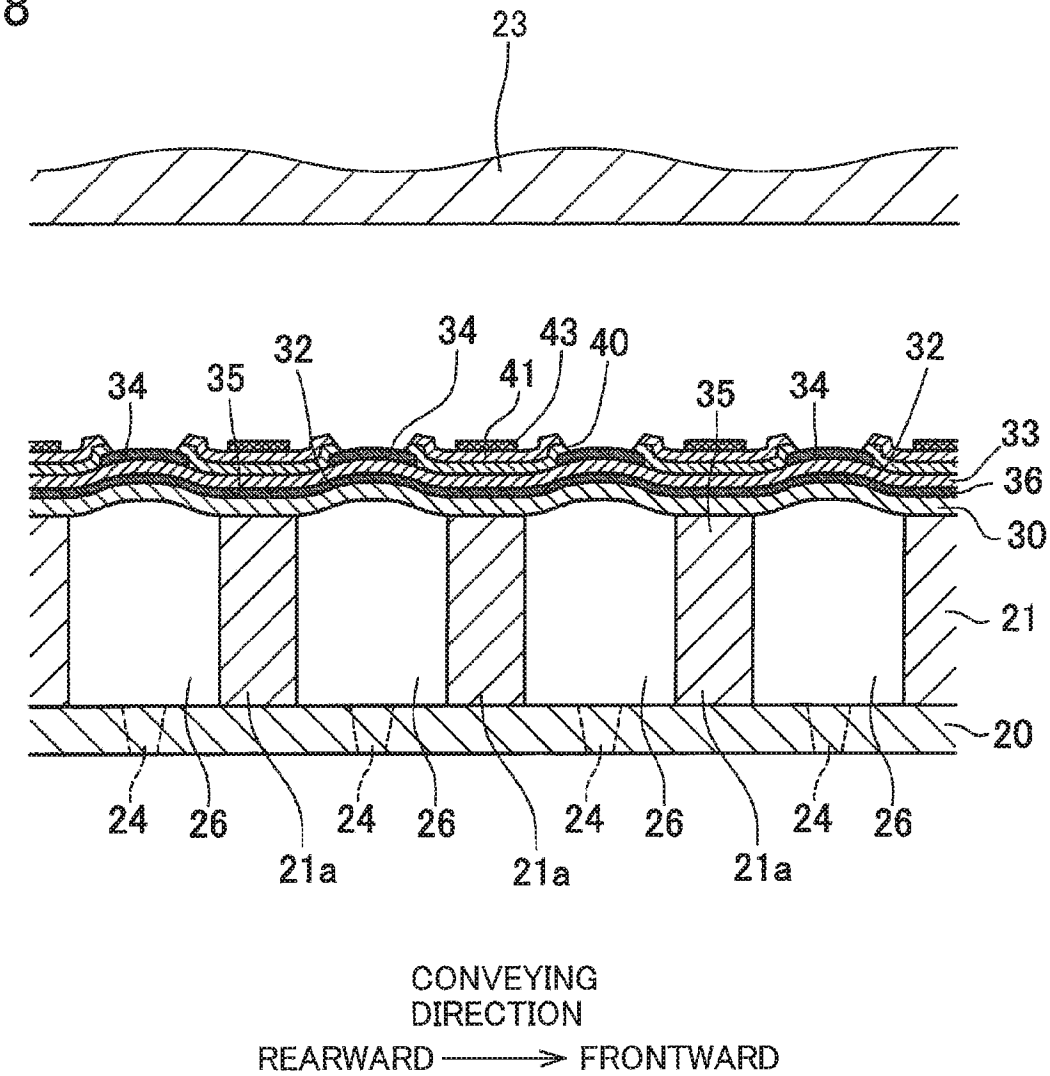
FIG. 8 is a view corresponding to the portion of FIG. 6 in a state where pressure chambers are formed in a channel member of the inkjet head of the according to the embodiment.

In S108 the plurality of pressure chambers 26 is formed by first polishing the silicon substrate to a thickness suited to the depth D of the pressure chambers 26 and subsequently wet etching or dry etching the silicon substrate from the side opposite the protective member 23. After the pressure chambers 26 are formed in the silicon substrate, the portions of the vibrating film 30 and piezoelectric films 33 vertically overlapping the pressure chambers 26 are no longer restrained by the silicon substrate. At the same time, the second electrodes 34 possess compressive stress, as described above. The compressive stress in the second electrodes 34 causes the portions of the vibrating film 30 and piezoelectric film 33 vertically overlapping the pressure chambers 26 to deflect convexly toward the side opposite the pressure chambers 26, as illustrated in FIG. 8.

In S109 the nozzle plate 20 having the plurality of nozzles 24 formed therein is bonded to the silicon substrate. At this time, a water-repellent film may be formed over the surface of the nozzle plate 20 on the side opposite the channel member 21. In S110 a dicing process is performed to cut the silicon substrate down to a size suitable for the channel member 21.

In S111 a polarizing process is performed for polarizing the piezoelectric films 33 by applying a voltage across the first electrodes 32 and second electrodes 34 under high temperatures. At this time, the piezoelectric films 33 have a (001) preferential orientation with a ratio of (001) orientation to (100) orientation of at least 50% and preferably 80% or greater. By providing the piezoelectric films 33 with (001) preferential orientation, the portions of the vibrating film 30 and piezoelectric films 33 vertically overlapping the pressure chambers 26, which were deflected convexly toward the side opposite the pressure chambers 26 as illustrated in FIG. 8, are now deflected convexly toward the pressure chambers 26 as illustrated in FIG. 6.

In S112 the COFs 50 are bonded to the left and right edges of the piezoelectric actuator 22. In S113 other remaining parts not shown in the drawings are bonded to the structure, thereby completing manufacturing of the inkjet head 4.

Note that the polarizing process in S111 may be performed prior to the dicing process of S110 or following the COF 50 bonding process of S112.

Examples

Next, various examples of the present disclosure will be described.

Examples A1-A11 and a comparative example A are results of experiments on displacement crosstalk. The amount of deflection in the vibrating film 30 and piezoelectric film 33 while a potential difference was not produced between the first electrode 32 and second electrode 34 was varied among the examples A1-A11 and the comparative example A.

Table 1 shows a relationship between the deflection amount T described above and displacement crosstalk (displacement CT in the table) for the examples A1-A11 and the comparative example A.

TABLE 1

| | Deflection Amount T (nm) | Displacement CT (%) |
|---|---|---|
| Comparative Example A | −167 | 14.0 |
| Example A1 | 276 | 10.0 |
| Example A2 | 258 | 9.5 |
| Example A3 | 201 | 11.3 |
| Example A4 | 203 | 11.4 |
| Example A5 | 244 | 10.6 |
| Example A6 | 300 | 11.0 |
| Example A7 | 400 | 9.0 |
| Example A8 | 483 | 6.6 |
| Example A9 | 523 | 5.1 |
| Example A10 | 595 | 3.3 |
| Example A11 | 596 | 1.6 |

a positive value for the deflection amount T indicates convex deflection toward the pressure chambers 26, while a negative value indicates convex deflection toward the side opposite the pressure chambers 26. Further, the values for displacement crosstalk in Table 1 are all positive values, but this indicates that displacement when neighboring piezoelectric elements 31 are driven simultaneously is greater than displacement when neighboring piezoelectric elements 31 are not driven simultaneously.

From the results in Table 1, it is clear that displacement crosstalk is smaller in the examples A1-A11 in which the vibrating film 30 and piezoelectric films 33 are deflected convexly toward the pressure chamber 26 side than in the comparative example A in which the vibrating film 30 and piezoelectric films 33 are deflected convexly toward the side opposite the pressure chambers 26.

Examples B1-B6 and comparative examples B1-B3 are the results of experiments on ejection crosstalk. The amount of deflection T in the vibrating film 30 and piezoelectric films 33 while a potential difference was not produced between the first electrode 32 and second electrode 34 was varied among the examples B1-B6 and the comparative examples B1-B3.

Table 2 shows a relationship between the deflection amount T and ejection crosstalk (ejection CT in the table) for each example.

TABLE 2

| | Deflection Amount T (nm) | Ejection CT (%) |
|---|---|---|
| Example B1 | 483 | 2.0 |
| Example B2 | 483 | −1.0 |
| Example B3 | 483 | −3.0 |
| Example B4 | 400 | 16.0 |
| Example B5 | 400 | 15.0 |
| Example B6 | 400 | 14.0 |
| Comparative Example B1 | −167 | 33.0 |
| Comparative Example B2 | −167 | 33.0 |
| Comparative Example B3 | −167 | 35.0 |

In Table 2, a positive value for the deflection amount T indicates convex deflection toward the pressure chamber 26 side, while a negative value indicates convex deflection toward the side opposite the pressure chambers 26. Further, a positive value for ejection crosstalk in Table 2 indicates that the ejection speed is faster when neighboring piezoelectric elements 31 are driven simultaneously than when neighboring piezoelectric elements 31 are not driven simultaneously, and a negative value indicates that the ejection speed is slower when neighboring piezoelectric elements 31 are driven simultaneously than when neighboring piezoelectric elements 31 are not driven simultaneously.

Based on the results in Table 2 it is clear that ejection crosstalk is lower in the examples B1-B6 in which the vibrating film 30 and piezoelectric films 33 are deflected convexly toward the pressure chamber 26 side than in the comparative examples B1-B3 in which the vibrating film 30 and piezoelectric films 33 are deflected convexly toward the side opposite the pressure chambers 26.

As shown in Tables 1 and 2, the deflection amount T in the examples A1-A11 and B1-B6 are all less than or equal to 1% the width W of the pressure chamber 26 (less than or equal to approximately 650 nm). Hence, crosstalk can be kept sufficiently low (no greater than 12% for displacement crosstalk and no greater than 16% for ejection crosstalk) when the deflection amount T is no greater than 1% the width W of the pressure chamber 26.

Further, the results in the examples A7 and A8 in Table 1 and examples B1-B6 in Table 2 show that crosstalk can be kept sufficiently low (no greater than 10% for displacement crosstalk and no greater than 16% for ejection crosstalk) when the deflection amount T is between 400 and 500 nm.

In addition, X-ray diffraction was performed on a sample with deflection toward the pressure chamber side produced through the same polarization process used for the example A1 and a sample with deflection toward the side opposite the pressure chamber side equivalent to the comparative example A to evaluate the ratio of (001) orientation to (100) orientation based on the intensity of the (400) and (004) peaks in Miller indices. In this evaluation, a single peak in the (400) region was observed for the sample having deflection toward the side opposite the pressure chamber side (the peaks at (400) and (004) were inseparable under the observation conditions), while twin peaks at (400) and (004) were observed in the sample having deflection toward the pressure chamber side, and the ratio of their integrated intensities was 5.7:4.3. Thus, the ratio at (004) had increased approximately 50% in the sample with deflection toward the pressure chamber side.

Figure 9:
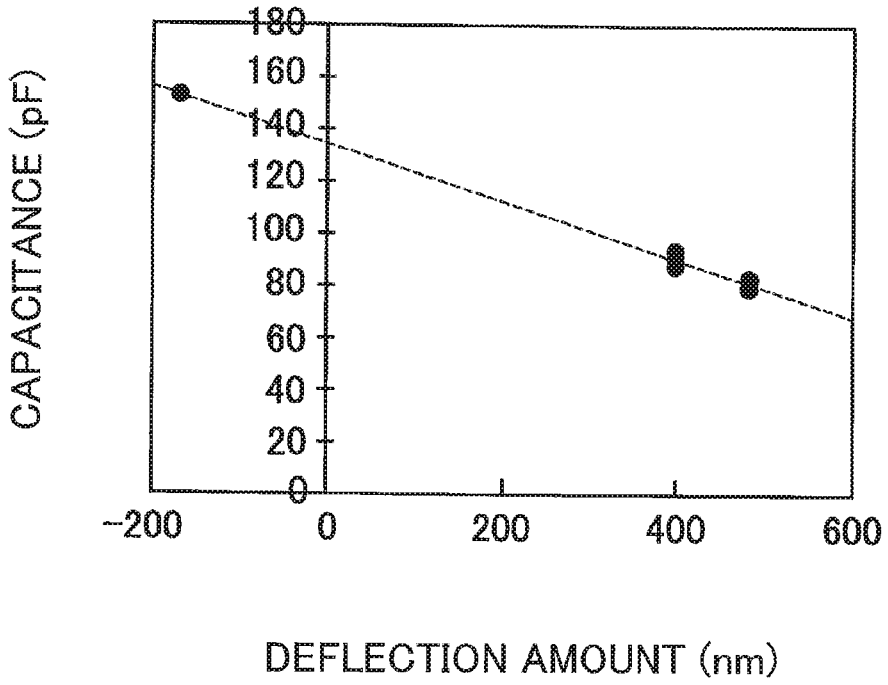
FIG. 9 is a graph illustrating a relationship between deflection and electrostatic capacity.

PZT is commonly known to have higher relative permittivity with (100) orientation than with (001) orientation. In other words, the (001) orientation has lower capacitance (electrostatic capacity) and can reduce power consumption better than the (100) orientation. FIG. 9 is a graph plotting deflection amounts in relation to capacitance. Capacitance drops as the amount of deflection increases toward the pressure chamber side, indicating that the ratio of (001) orientation increases as the amount of deflection increases. Under the conditions of the example A1, the ratio of (001) orientation is approximately 50% with a deflection amount of 276 nm. This ratio increases further under conditions with larger deflection amounts that are more suitable for reducing crosstalk.

<Advantages Effects>

Since the second electrodes 34 of the embodiment have compressive stress, the piezoelectric films 33 possess tensile stress that tends to produce (100) orientation. However, by polarizing the piezoelectric films 33 in the embodiment, a ratio of at least 50% (001) orientation to (100) orientation is achieved. Therefore, the piezoelectric films 33 have good piezoelectric properties.

Further, by polarizing the piezoelectric films 33 to increase the ratio of (001) orientation to (100) orientation, the piezoelectric films 33 can be contracted so that the vibrating film 30 and piezoelectric films 33 deflect convexly toward the pressure chamber 26 side. As described above, crosstalk is less likely to occur when the vibrating film 30 and piezoelectric film 33 deflect convexly toward the pressure chamber 26 side than when they deflect convexly toward the side opposite the pressure chamber 26 side.

The piezoelectric properties of the piezoelectric films 33 can be sufficiently improved by further increasing the ratio of (001) orientation to (100) orientation in the piezoelectric films 33 to 80% or greater.

While precise piezoelectric films 33 can be formed according to the sol-gel process as described in the embodiment, piezoelectric films 33 formed through this sol-gel process generally tend to have (100) orientation. Therefore, it is important to improve the ratio of (001) orientation to (100) orientation by polarizing the piezoelectric films 33 as described above.

When using the sol-gel process, the piezoelectric film 33 can be formed as thin as 2 μm or less, thereby increasing the strength of the electric field produced in the piezoelectric film 33 when a voltage is applied across the first electrodes 32 and second electrodes 34 and, hence, increasing the amount of displacement T produced in the piezoelectric film 33.

Further, while the ratio of depth D to width W of the pressure chamber 26 is approximately two times, a ratio between one time and three times can achieve the same effects of reducing crosstalk illustrated in the above examples.

Further, while the depth D of the pressure chamber 26 is approximately 125 μm in the embodiment, a depth in a range from 50-180 μm can achieve the same effects of reducing crosstalk illustrated in the above examples.

Under a structure where the vibrating film 30 and piezoelectric film 33 are deflected convexly toward the pressure chamber 26 side, if this deflection amount T is too large relative to the width W of the pressure chamber 26, the amount of deformation of the vibrating film 30 and piezoelectric film 33 when a voltage is applied across the first electrode 32 and second electrode 34 may be too small to obtain sufficient ejection speed.

Accordingly, the deflection amount T is controlled to be no greater than 1% of the width W of the pressure chamber 26 in the embodiment. As shown in the above examples, this technique can maximize the amount of deformation T in the vibrating film 30 and piezoelectric film 33 when a voltage is applied across the first electrode 32 and second electrode 34, while deflecting the vibrating films 30 and piezoelectric film 33 convexly toward the pressure chamber 26 side to reduce the likelihood of crosstalk.

While the deflection amount T described above is approximately 450 nm in the embodiment, the deflection amount T may be in a range from 400-500 nm. As shown in the above examples, this technique can maximize the amount of deformation T in the vibrating film 30 and piezoelectric film 33 when a voltage is applied across the first electrodes 32 and second electrodes 34, while deflecting the vibrating film 30 and piezoelectric film 33 convexly toward the pressure chamber 26 side to reduce the likelihood of crosstalk.

While the description has been made in detail with reference to the embodiment thereof, it would be apparent to those skilled in the art that many modifications and variations may be made therein without departing from the scope of the disclosure.

For example, in the embodiment described above, the deflection amount T of the vibrating film 30 and piezoelectric film 33 when a potential difference is not being produced between the first electrode 32 and second electrode 34 is between 400 and 500 nm, but the deflection amount T may be less than 400 nm or greater than 500 nm.

In the embodiment described above, the deflection amount T of the vibrating film 30 and piezoelectric film 33 while a potential difference is not being produced between the first electrode 32 and second electrode 34 is no greater than 1% of the width W of the pressure chamber 26, but the deflection amount T may be greater than 1% of the width W of the pressure chamber 26.

In the embodiment described above, the depth D of the pressure chamber 26 is between 50 and 150 μm, but the depth D of the pressure chamber 26 may be less than 50 μm or greater than 150 μm.

In the embodiment described above, the ratio of the depth D to the width W of the pressure chamber 26 is between one and three times, but the ratio of the depth D to the width W of the pressure chamber 26 may be less than one time or greater than three times.

In the embodiment described above, the thickness E2 of the piezoelectric film 33 is set to 2 μm or less, which is thinner than the thickness E1 of the vibrating film 30. However, the present disclosure is not limited to this configuration. For example, the thickness E2 of the piezoelectric film 33 may be set greater than 2 μm, provided that the thickness E2 is thinner than the thickness E1 of the vibrating film 30. Alternatively, the thickness E2 of the piezoelectric film 33 may be set greater than or equal to the thickness E1 of the vibrating film 30.

In the embodiment described above, the piezoelectric films 33 are formed according to the sol-gel process, but the piezoelectric films 33 may be formed according to another method, such as sputtering.

In the embodiment described above, the common electrode 36 is formed between the piezoelectric films 33 and vibrating film 30 by linking neighboring first electrodes 32 through conductive parts 35, and the second electrodes 34 arranged on the top surfaces of the piezoelectric films 33 are individual electrodes provided for each individual pressure chamber 26. However, the first electrodes 32 disposed between the piezoelectric films 33 and vibrating film 30 may instead be individual electrodes provided for each individual pressure chamber 26, and a common electrode may be formed by linking neighboring second electrodes 34 arranged on the top surfaces of the piezoelectric films 33.

Further, while the embodiment provides an example for applying the present disclosure to an inkjet head that ejects ink from nozzles, the present disclosure may be applied to a liquid ejection head that ejects a liquid other than ink, such as a liquefied metal or resin.

<Remarks>

The inkjet head 4 is an example of a liquid ejection head. The nozzles 24 are an example of nozzles. The channel member 21 is an example of a channel member. The pressure chambers 26 are an example of a plurality of pressure chambers. The piezoelectric elements 31 are an example of a plurality of piezoelectric elements. The vibrating film 30 (a portion thereof corresponding to each pressure chamber 26) is an example of a vibrating film. The piezoelectric film 33 (a portion thereof corresponding to each pressure chamber 26) is an example of a piezoelectric film. The first electrodes 32 are an example of a first electrode. The second electrodes 34 are an example of a second electrode.

What is claimed is:

1. A liquid ejection head comprising:

a plurality of nozzles;

a channel member comprising a plurality of pressure chambers each in communication with a corresponding one of the plurality of nozzles; and a plurality of piezoelectric elements each provided for a corresponding one of the plurality of pressure chambers, each of the plurality of piezoelectric elements comprising:

a vibrating film covering the corresponding pressure chamber;

a piezoelectric film positioned opposite to the corresponding pressure chamber with respect to the vibrating film;

a first electrode interposed between the vibrating film and the piezoelectric film; and a second electrode positioned opposite to the vibrating film with respect to the piezoelectric film, wherein the vibrating film, the piezoelectric film, the first electrode, and the second electrode vertically overlap the corresponding pressure chamber, wherein the second electrode has compressive stress, wherein the piezoelectric film has a ratio of (001) orientation to (100) orientation that is equal to or greater than 50%, and wherein the vibrating film and the piezoelectric film are deflected convexly toward the corresponding pressure chamber while no potential difference is being produced between the first electrode and the second electrode.

2. The liquid ejection head according to claim 1, wherein the piezoelectric film is a film formed according to sol-gel process.

3. The liquid ejection head according to claim 2, wherein the piezoelectric film has a thickness smaller than a thickness of the vibrating film.

4. The liquid ejection head according to claim 3, wherein the thickness of the piezoelectric film is less than or equal to 2.0 μm.

5. The liquid ejection head according to claim 1, wherein each of the pressure chambers defines a depth and a width, a ratio of the depth to the width being between one time and three times.

6. The liquid ejection head according to claim 1, wherein each of the pressure chambers defines a depth that is between 50 μm and 150 μm.

7. The liquid ejection head according to claim 1, wherein the vibrating film and the piezoelectric film are deflected convexly toward the corresponding pressure chamber to provide a deflection amount while no potential difference is being produced between the first electrode and the second electrode, the deflection amount being less than or equal to 1% of the width of the corresponding pressure chamber.

8. The liquid ejection head according to claim 1, wherein the vibrating film and the piezoelectric film are deflected convexly toward the corresponding pressure chamber to provide a deflection amount while no potential difference is being produced between the first electrode and the second electrode, the deflection amount being in a range from 400-500 nm.

9. The liquid ejection head according to claim 1, wherein the piezoelectric film is polarized such that the ratio of (001) orientation to (100) orientation in the piezoelectric film is 80% or greater.

* * * * *